US005364098A

United States Patent [19]

Kaminkow

[11] Patent Number: 5,364,098

[45] Date of Patent: Nov. 15, 1994

[54] ROLLING BALL GAME WITH AUXILIARY CONTROL

[75] Inventor: Joseph E. Kaminkow, Arlington Heights, Ill.

[73] Assignee: Data East Pinball, Inc., Melrose Park, Ill.

[21] Appl. No.: 118,508

[22] Filed: Sep. 8, 1993

[51] Int. Cl.[5] ..... A63F 7/30

[52] U.S. Cl. ..... 273/119 R; 273/119 A

[58] Field of Search ..... 273/118-125, 273/127 R

[56] References Cited

U.S. PATENT DOCUMENTS

| | | | |
|---|---|---|---|
| 2,614,840 | 10/1952 | Monkres | 273/121 A |
| 2,646,987 | 7/1953 | Hatherell | 273/121 A |
| 4,097,047 | 6/1978 | Ochi | 273/127 R |
| 4,363,485 | 12/1982 | Edwall | 273/121 A |
| 4,373,725 | 2/1983 | Ritchie | 273/121 A |
| 5,137,278 | 8/1992 | Schilling et al. | 273/119 AX |
| 5,149,094 | 9/1992 | Tastad | 273/119 AX |

*Primary Examiner*—Vincent Millin
*Assistant Examiner*—Raleigh W. Chiu
*Attorney, Agent, or Firm*—Gerstman, Ellis & McMillin, Ltd.

[57] ABSTRACT

A rolling ball entertainment device such as a pinball machine comprises a frame which carries a playfield, plus a shooter for rolling a ball onto the playfield. By this invention the device also includes signalling device, an auxiliary control, and electronics for activating the signalling device. Also, a timer is provided for defining a period of time beginning with the activating of the signalling device. The electronics, connected to a feature of the device, permit the auxiliary control to activate the feature during the period of time. This provides an added dimension to rolling ball entertainment games in which an alert player can improve the score by use of the auxiliary control in those periods as indicated by the signalling device.

11 Claims, 1 Drawing Sheet

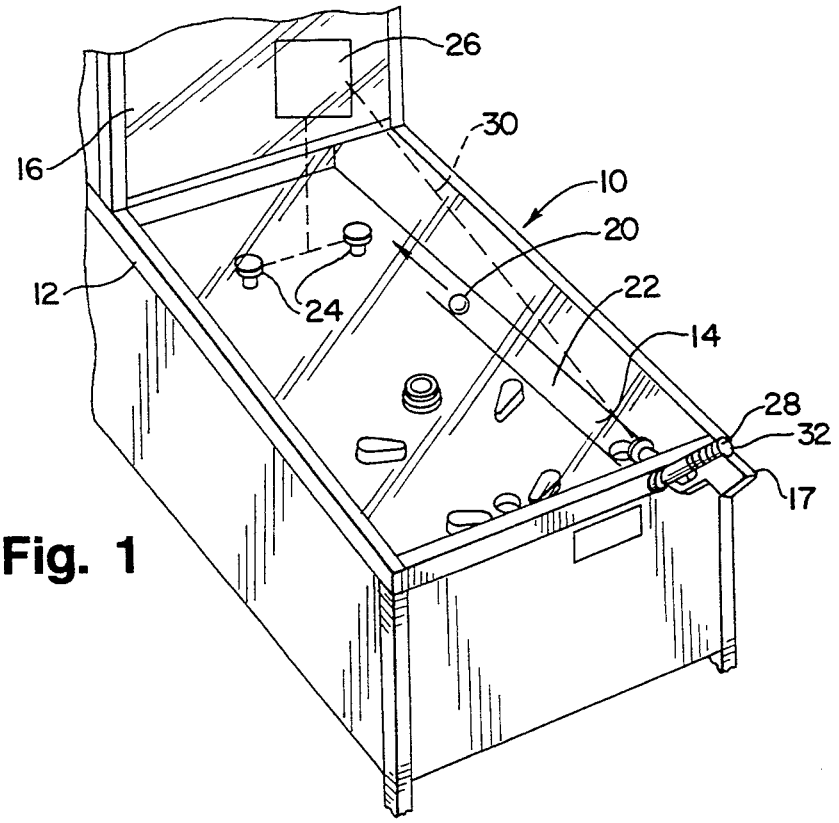
Fig. 1
Fig. 3
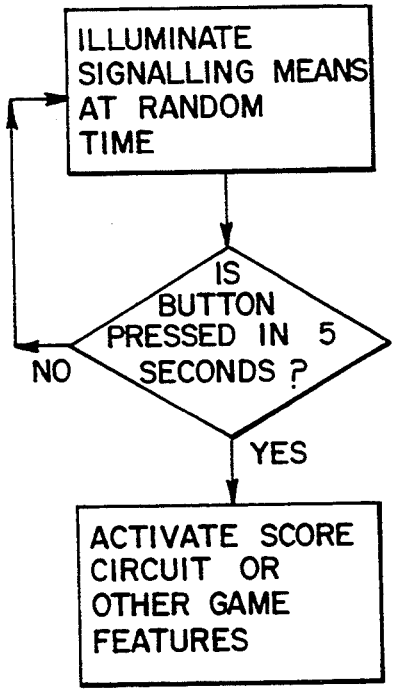
Fig. 2
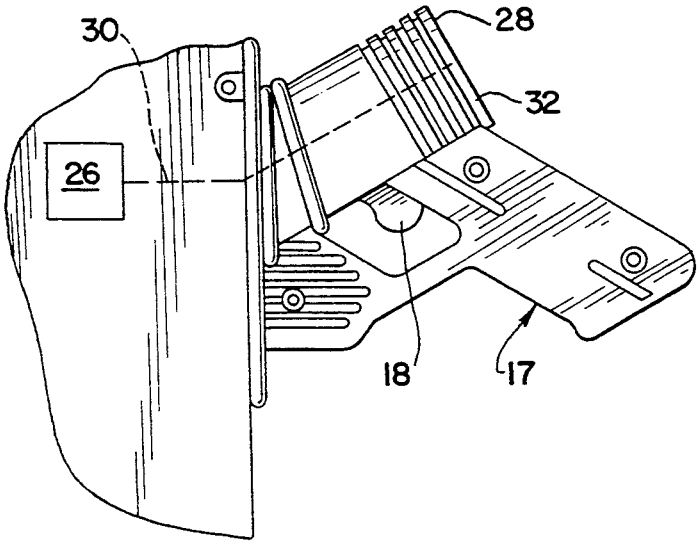

ROLLING BALL GAME WITH AUXILIARY CONTROL

BACKGROUND OF THE INVENTION

Rolling ball entertainment devices or games have a great popularity, which is based in large measure upon novel features found in the game, to provide added opportunities for skill while also providing new characteristics of the game, to hold the attention and interest of the players.

By this invention, an auxiliary control is provided which is only intermittently available to the player for operation. Thus, if the player can catch the moment when the control may be operated, benefits in the game may be achieved and the score increased.

DESCRIPTION OF THE INVENTION

By this invention, a rolling ball entertainment device such as a pinball machine comprises a frame which carries a playfield, plus means for shooting a rolling ball on the playfield. The device also includes signalling means, which may simply be an illuminatable light of some conventional type, although other signalling systems may be used if desired. An auxiliary control is also provided, which auxiliary control is activatable by the user only at a certain period or periods of time throughout play of the game.

Means are also provided for activating the signalling means, such as by illuminating. Timer means are provided for defining a period of time beginning with the activation of the signal means. Then, means are connected to a feature of the device to permit the auxiliary control to activate the feature during that period of time that the signal means is activated. Preferably, the last named means permits the auxiliary control to activate that feature only during such period of time.

The term "feature" is intended to include any of a large variety of functions of the rolling ball entertainment device. For example, the feature activated may be a scoring circuit which automatically adds a score to the credit of the player. Otherwise, a double score may be provided for the next scoring feature engaged by the rolling ball. Alternatively, a desirable feature of the game may be automatically started, when the desired feature is normally only started by striking a certain scoring member of the game or the like. As another alternative, added balls for play may be awarded to the user, etc.

The means for activating the signalling means may operate in response to a substantially random timing circuit. The signalling means provides indication of the availability of the auxiliary control for use at times that may appear to be random to the user. It is not necessary for a true randomizing circuit to be used, since an apparent randomness, which may be provided from simpler circuits than a true randomizing circuit, can be sufficient to provide adequate challenge to the user's powers of observation and dexterity during play. Alternatively, if desired, the means for activating the singling means may operate at predicted times from the viewpoint of the player, for example when a particular score has been achieved or the like.

It is also preferred for the shooting means to have a manual control, while also carrying the auxiliary control. Likewise, the auxiliary control may carry the signalling means, for example so that the light of the signalling means illuminates a button which comprises the auxiliary control, to attract the user's observation so that he can to press the bottom.

Thus, a new rolling ball entertainment device feature is provided by this invention, to contribute to the interest of the various users of the game.

DESCRIPTION OF THE DRAWING

In the drawings, FIG. 1 is a perspective view of a rolling ball entertainment device, incorporating one embodiment of this invention;

FIG. 2 is an enlarged elevational view of the auxiliary control and the signalling means as embodied in FIG. 1; and FIG. 3 is a flow chart showing an embodiment of the operation of the improvement of this invention.

DESCRIPTION OF SPECIFIC EMBODIMENTS

Referring to the drawings, a pinball machine 10 is shown having a frame 12 which carries a playfield 14, being equipped with a backboard 16, typically in the conventional manner of pinball machines. A ball shooter assembly 17 is provided, which comprises a trigger 18 which actuates a plunger or other conventional means to propel ball 20 through shooter channel 22 out onto the playfield 14.

During the operation of the pinball game, as the ball is striking various targets 24 and engaging in other features, microprocessor 26, typically mounted in backboard 16, may have as one of its functions a randomizing or other circuit which selects a time during operation of the game for activation of auxiliary control 28 by signalling through connecting electronic cable 30. Simultaneously, microprocessor 26 activates a light or LED 32 in auxiliary control 28, which may be comprise a control button with an illuminatable face. When the control button 28 is illuminated by light 32, button 28 becomes connected to send a signal back to microprocessor 26 through cable 30 or other means as may be desired, to signal microprocessor 26 to actuate, for example, targets 24, causing a score of those targets to be recorded, even though targets 24 have not been struck at that moment by ball 20.

If, however, the user fails to press button 28 while it is illuminated by light 32, at the end of the elapsed time provided by a timing circuit in microprocessor 26, (which may be for example five seconds) button 28 is once again deactivated, to no longer function until such time as it is activated once again by the randomizing circuit in microprocessor 26.

Such a microprocessor may be similar to current microprocessors used in pinball machines, being modified in a manner which is conventional to those skilled in the art to accomplish the desired functions described above.

Alternatively, other functions may be initiated by pressing the button of auxiliary control 28 during the time period as defined by microprocessor 26, when the auxiliary control is activated.

Shooter 17 is actuated by the user's pulling of trigger 18 for the launching of balls 20 in accordance with the dictates of the game, pinball machine 10 may be of the single ball type or the multiple ball type, and in which a ball or balls may be either manually or automatically launched, depending upon the events taking place in the game.

At the end of the time period in which auxiliary control 28 is activated, light 32 is shut off, indicating such deactivation.

Thus, the user, while watching the game and exercising such controls as are available in conventional pinball games, must also watch auxiliary control 28, to be ready to push it whenever it is illuminated, as an improvement and an added feature to pinball and other rolling ball entertainment devices.

The above has been offered for illustrative purposes only, and is not intended to limit the scope of the invention of this application, which is as defined in the claims below.

That which is claimed is:

1. A rolling ball entertainment device which comprises a frame which carries a playfield, and means for shooting a rolling ball onto said playfield, said device also including signaling means, an auxiliary control, means for activating said signaling means, a timer for defining a period of time beginning with the activating of said signalling means, and means connected to a feature of said device permitting said auxiliary control to activate said feature during said period of time, said shooting means having a manual control which also carries said auxiliary control.

2. The entertainment device of claim 1 in which said timer means defines a substantially random timer circuit, in which said means for activating said signaling means is connected to operate in response to said substantially random timing circuit.

3. The entertainment device of claim 1 in which said signaling means comprises an illuminatable device.

4. The entertainment device of claim 1 in which said auxiliary control carries said signalling means.

5. The entertainment device of claim 1 in which said means connected to a feature of said device permits the auxiliary control to activate the feature only during said period of time.

6. A rolling ball entertainment device which comprises a frame which carries a playfield, and means for shooting a rolling ball onto said playfield, said device also including signalling means, an auxiliary control, means for activating said signalling means in response to a substantially random timing circuit; a timer for defining a period of time beginning with the activation of said signalling means; and means connected to a feature of said device permitting said auxiliary control to activate said feature during said period of time, said signalling means operating by illumination, said shooting means having a manual control which also carries said auxiliary control.

7. The entertainment device of claim 6 in which said means connected to a feature of said device permits the auxiliary control to activate the feature only during said period of time.

8. The entertainment device of claim 7 in which said auxiliary control carries said signalling means.

9. A rolling ball entertainment device which comprises a frame which carries a playfield, and means for shooting a rolling ball onto said playfield, said device also including signalling means, an auxiliary control, means for activating said signalling means in response to a substantially random timing circuit, a timer for defining a period of time beginning with the activation of said signal means, and means connected to a feature of said device permitting said auxiliary control to activate said feature during said period of time.

10. The entertainment device of claim 9 in which said means connected to a feature of said device permits the auxiliary control to activate the feature only during said period of time.

11. The entertainment device of claim 10 in which said auxiliary control carries said signalling means.

* * * * *